US006262644B1

(12) United States Patent
Castonguay et al.

(10) Patent No.: US 6,262,644 B1
(45) Date of Patent: Jul. 17, 2001

(54) LATCH RESETTING ARRANGEMENT

(75) Inventors: Roger Castonguay, Terryville; Girish Hassan, Plainville, both of CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/520,570

(22) Filed: Mar. 8, 2000

(51) Int. Cl.[7] ..... H01H 9/00
(52) U.S. Cl. ..... 335/167; 335/172
(58) Field of Search ..... 335/167–176, 335/23–25

(56) References Cited

U.S. PATENT DOCUMENTS 4,001,742 1/1977 Jencks et al. .
4,123,734 * 10/1978 Maier et al. ..... 335/9
4,622,530 * 11/1986 Ciarcia et al. ..... 335/167

* cited by examiner

*Primary Examiner*—Lincoln Donovan
*Assistant Examiner*—Tuyen T. Nguyen

(74) *Attorney, Agent, or Firm*—Cantor Colburn LLP; Carl B. Horton

(57) ABSTRACT

A latching mechanism of a circuit breaker operating mechanism comprises a primary latch and a secondary latch. The primary latch is of a general H-shape and includes elongated leg members connected by a cross member and has notched portions thereon proximate the first ends of the elongated leg members, reset feet depending from the second ends of the elongated leg members, and tabs protruding from the elongated leg members at points intermediate the first and second ends and extending in the general direction of the reset feet. The elongated leg members of the primary latch are pivotally mounted on an axis that extends laterally through a cross member. The secondary latch is of a general inverted U-shape and includes elongated leg members connected by a base member and has notched portions thereon proximate first ends of the elongated leg members. The elongated leg members of the secondary latch are also pivotally mounted on pins that protrude from the base member. The latching mechanism is engaged when the notched portions of the primary latch and the secondary latch are engaged and when the primary latch is engaged with a cradle assembly.

11 Claims, 3 Drawing Sheets

LATCH RESETTING ARRANGEMENT

BACKGROUND OF THE INVENTION

The present invention relates to circuit breakers, and, more particularly, to a means for resetting an operating mechanism latch which will not impede the trip time of the operating mechanism.

Circuit breaker operating mechanisms are used to control the opening and closing of separable contacts within a circuit breaker system. These operating mechanisms utilize linkage arrangements to translate the potential energy of biased springs into an output force required to quickly trip the circuit and separate the contacts in the event that a fault condition occurs.

In the prior art circuit breaker operating mechanisms, a torsion spring is typically used to bias two cooperative elements during the resetting of the latching system. For example, in U.S. Pat. No. 4,001,742 entitled "Circuit Breaker Having Improved Operating Mechanism", a torsion spring biases a primary latch in a counterclockwise direction about a pivot point of the primary latch while also biasing a secondary latch in a clockwise direction about a pivot point of the secondary latch thereby bringing both latches into latching engagement with each other. In the resetting operation of this system, however, the force of the torsion spring is a factor in the interengagement of the latches, and the time required of the mechanism to overcome that force may be significant.

While the torsion springs of the prior art systems adequately allow the elements of the latch linkage system to interengage and reset the operating mechanism, the latch linkage components must be displaced by the operating mechanism prior to the separation of the contacts. In low force output systems, this displacement requires a significant amount of time. The use of a torsion spring, therefore, the force of which must be overcome in the tripping operation, significantly increases the amount of time needed to separate the breaker contacts. An operating mechanism is needed that reduces the amount of time needed to trip the circuit breaker operating mechanism thereby allowing for faster separation of the breaker contacts.

SUMMARY OF THE INVENTION

A circuit breaker assembly includes a housing, a plurality of stationary contacts mounted proximate the housing, a movable contact arm pivotally mounted within the housing and having at least one movable contact disposed thereon, and an operating mechanism for moving the movable contact arm. The operating mechanism includes a cradle assembly pivotally mounted within the housing, a toggle assembly linkably connected to the movable contact aim and the cradle assembly, a handle operably connected to the cradle assembly, and a latch resetting mechanism operably connected to the cradle assembly and configured to retain the cradle assembly thereon.

The inventive latch resetting mechanism eliminates the torsion spring of the prior art systems and utilizes a latching arrangement wherein a secondary latch releasably sustains the primary latch in engagement with a cradle without the use of the spring. The mechanism includes primary and secondary latches. The primary latch is an elongated member having a notch formed therein and having an opening extending laterally therethrough for pivotally mounting the elongated member. The primary latch also includes a foot portion and a tab depending from the elongated member for engaging the cradle assembly. The secondary latch is also an elongated member having a notch formed therein and having an opening extending therethrough for pivotally mounting that elongated member. The secondary latch restingly engages the notched portion of the primary latch to prevent the pivotal motion of the primary latch.

The elimination of the torsion spring in the latching mechanism allows the latching system to be utilized in a circuit breaker operating mechanism having a trip unit that generally has a low force output. Because the force of the spring does not have to be overcome during the tripping operation, the latch linkage can be more easily displaced and the tripping time of the operating mechanism can be significantly educed.

DETAILED DESCRIPTION OF THE INVENTION

Figure 1:
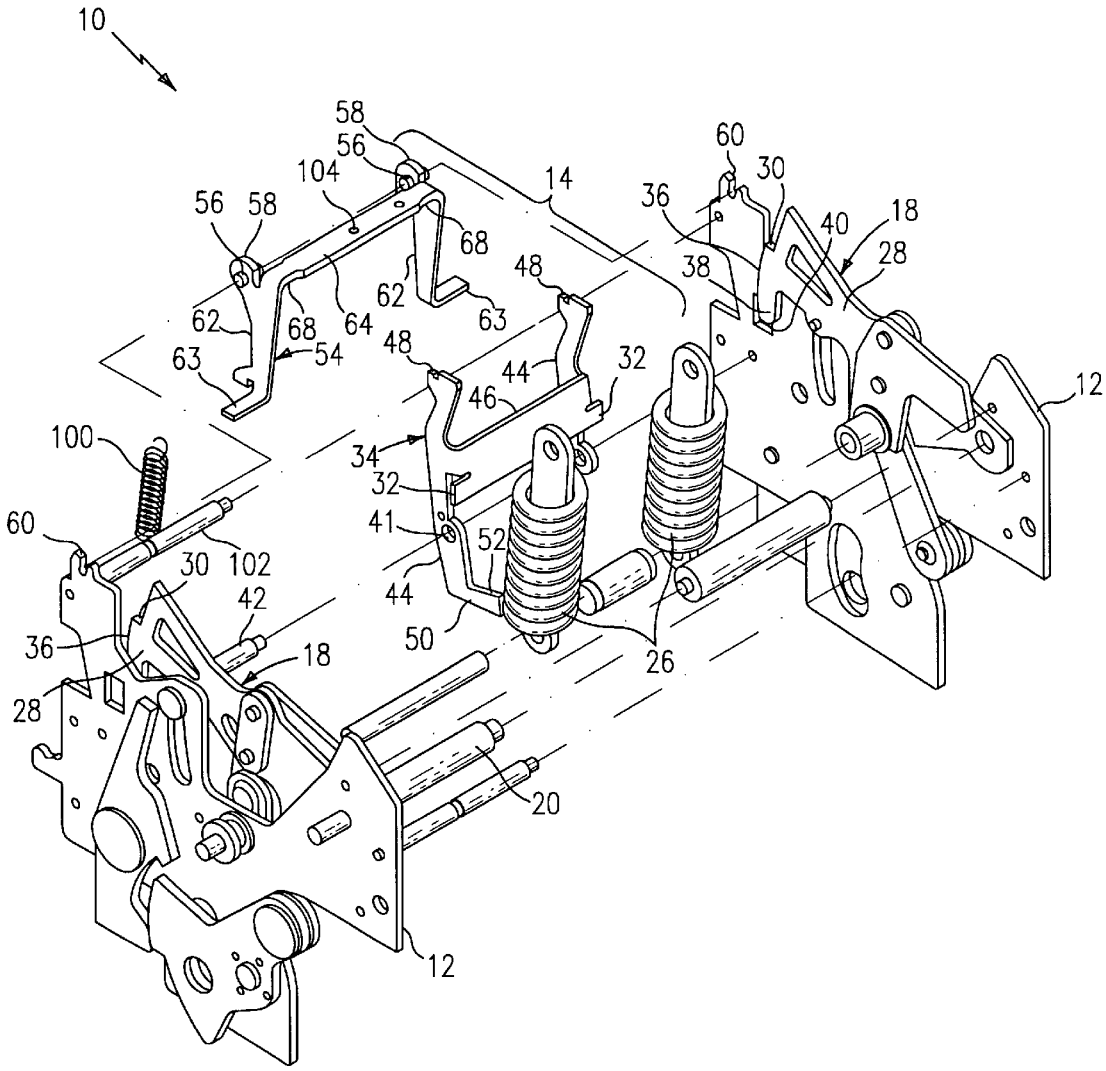
FIG. 1 is a perspective and exploded view of a circuit breaker operating mechanism illustrating the latching mechanism, of the present invention.

Referring to the Figures, a circuit breaker operating mechanism embodying the present invention is shown generally at 10. Circuit breaker operating mechanism 10 includes a pair of sideplates 12 fixedly spaced so as to be in a parallel configuration mounted to a cassette (not shown) within a circuit breaker housing (not shown). The inventive latching mechanism, shown generally at 14, is positioned between sideplates 12 and functions to latch and unlatch or trip operating mechanism 10. Also between sideplates 12 are mounted various parts necessary for the operation of mechanism 10. In particular, operating mechanism 10 further includes an operating handle 16 pivotally mounted on a pin 17 supported by sideplates 12 and protriding from therebetween, a cradle assembly shown generally at 1 8 and supported by a cradle support pin 20 between sideplates 12 and operably linked to operating handle 16, and a toggle linkage 22 connecting cradle assembly 18 to a pivotally mounted contact arm 24 upon which a pair of contacts 25 is fixed. A pair of tension springs 26 biases toggle linkage 22 to operating handle 16.

Cradle assembly 18 is shown in greater detail with reference to FIG. 1. Cradle assembly 18 comprises a pair of cradle plates 28 fixedly spaced apart in a parallel relationship. A latching shoulder 30 is formed on the corresponding edges of each cradle plate 28. Latching shoulder 30 is positioned, configured, and dimensioned to accommodate a latching tab 32, which is described in detail below. Camming surfaces 36, which are generally arcuate outer edges of cradle plates 28, are positioned adjacent to latching shoulders 30 on each cradle plate 28. Each cradle plate 28 further contains an arm 38 that is adjacent to camming surfaces 36 and depends therefrom. The end of each arm 38 terminates in a cradle stop surface 40.

Again referring to FIG. 1, latching mechanism 14 is shown. Latching mechanism 14 includes primary latch 34, which is pivotally mounted through an opening 41 on a latch pin 42 supported between sideplates 12. Primary latch 34 is a substantially H-shaped structure having two elongated leg members 44 connected by a cross bar 46. Latching tab 32 is a generally flat planar member protruding from cross bar 46 in a coplanar fashion and is engageable with latching shoulders 30 on cradle plates 28 when operating mechanism 10 is moved from a tripped position to a reset position. A notched area 48 is formed into an upper part of each elongated leg member 44. Primary latch 34 further includes a reset foot 50 formed into a lower part of elongated leg member 44 that interacts with cradle assembly 18 to reset operating mechanism 10. A contact surface 52 is disposed on an upper surface of reset foot 50.

Latching mechanism 14 also includes a secondary latch shown generally at 54, which is also pivotally mounted between sideplates 12. Secondary latch 54 is a substantially U-shaped structure having pins 56 integrally formed into tabs 58 projecting therefrom and is mounted between sideplates 12 by engaging pins 56 with slots 60 in sideplates 12. Although secondary latch 54 is mounted between sideplates 12, elongated leg members 62 of secondary latch 54 depending from a base member 64 each hang over the outer surfaces of sideplates 12 thereby causing secondary latch 54 to straddle operating mechanism 10. Elongated leg members 62 have disposed on the ends thereof feet 63, which extend perpendicularly away from elongated leg members 62. Notched areas 68 are positioned on base member 64 proximate the points where elongated leg members 62 meet base member 64 and are configured to be engageable with notched areas 48 on primary latch 34.

Figure 2:
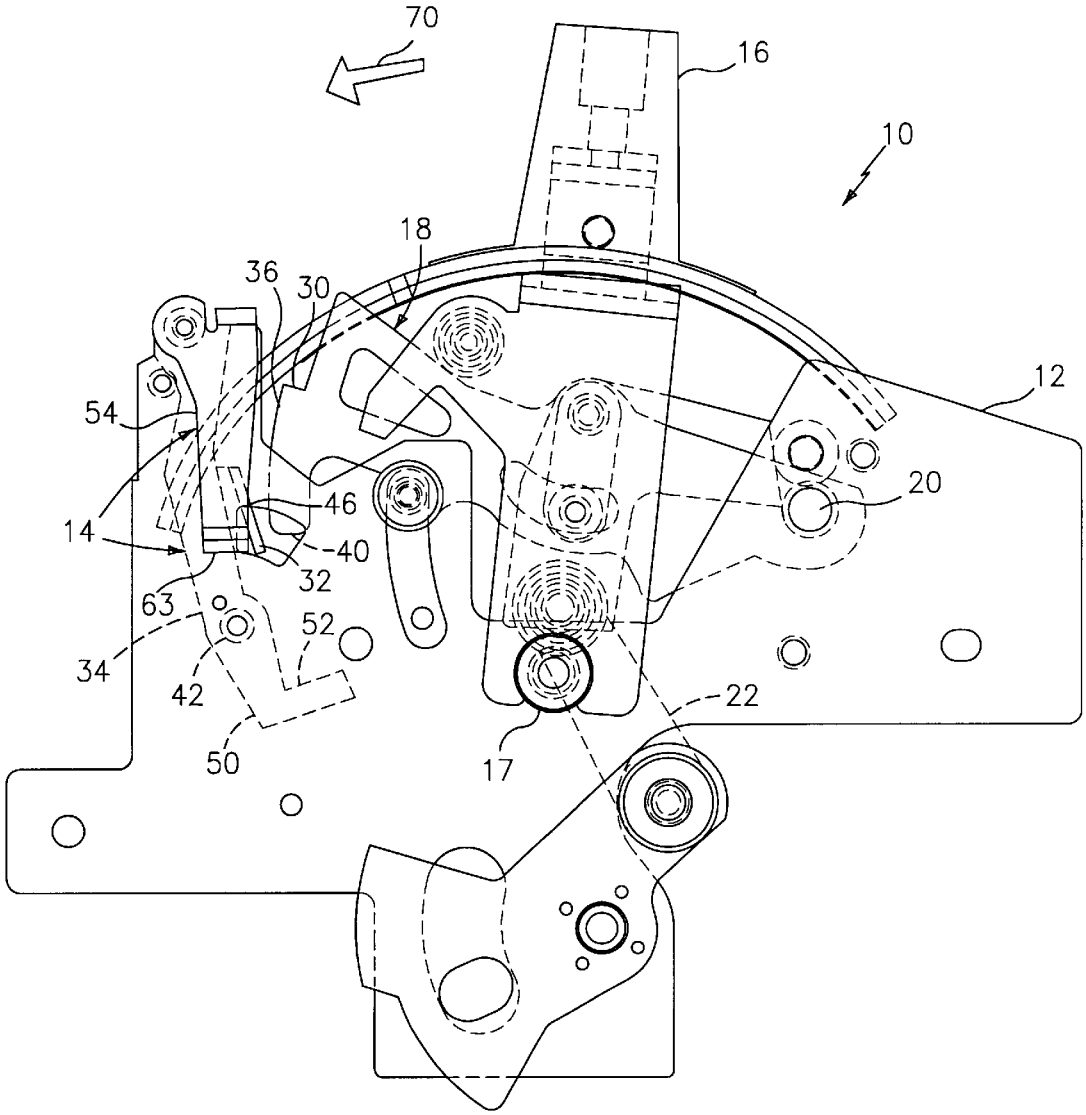
FIG. 2 is a side elevation cutaway view of the latching mechanism, of the present invention, in the tripped position.
Figure 3:
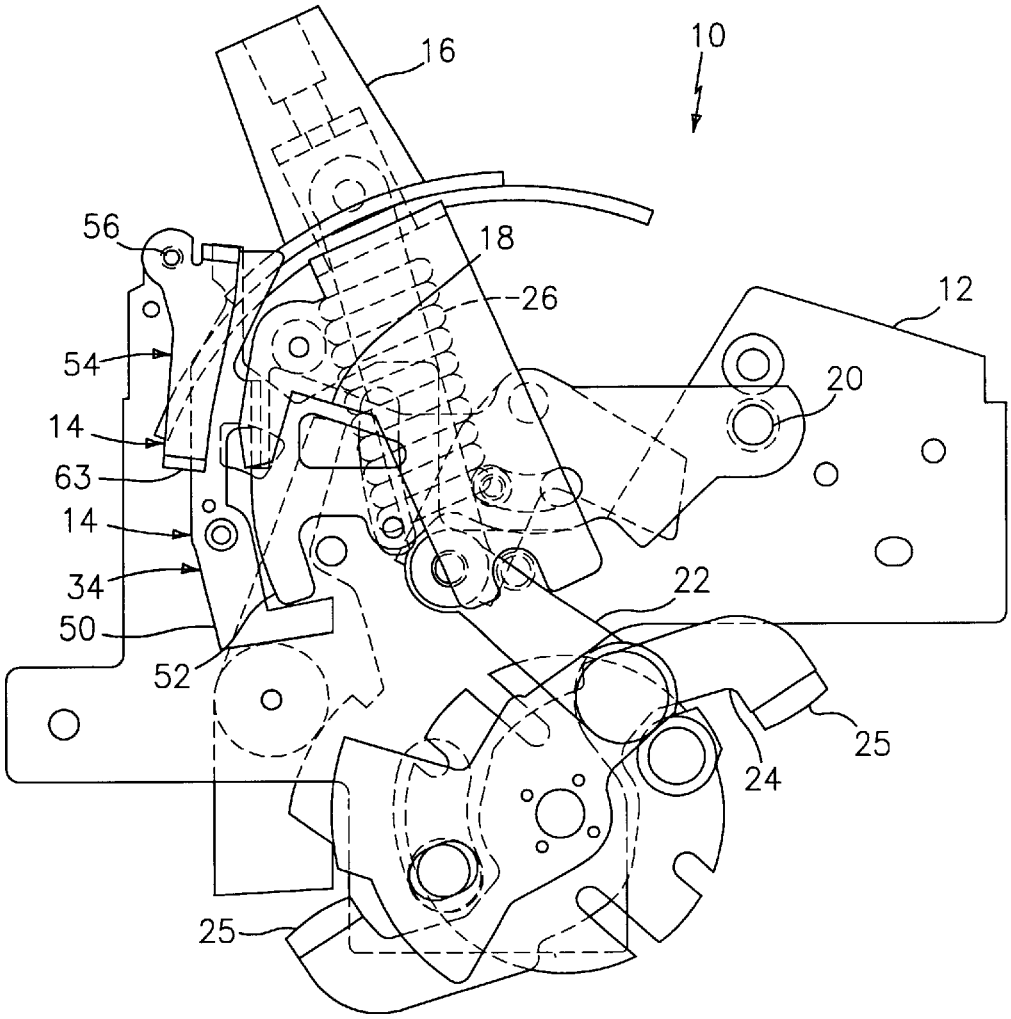
FIG. 3 is a side elevation cutaway view of the latching mechanism, of the present invention, in the reset position.

In FIG. 2, operating mechanism 10 is shown in a tripped position. Tripping of operating mechanism 10 is effectuated when one of feet 63 is rotated in a counterclockwise direction about a tripping device (not shown), thereby releasing latching mechanism 14. The movement of operating handle 16 in the direction of an arrow 70 effectuates articulation of operating mechanism 10 from the tripped position to the reset position of FIG. 3. This movement necessitates the movement of cradle assembly 18 in a counterclockwise direction about cradle support pin 20 and ultimately results in cradle assembly 18 being latched by primary latch 34 and primary latch 34 being latched by secondary latch 54. Cradle assembly 18 pivots and causes camming surfaces 36 to brushably contact the face surfaces of cross bar 46, thereby pivoting primary latch 34 outward and away from the center of operating mechanism 10 (counterclockwise as shown). Once camming surfaces 36 move completely past cross bar 46, the engagement of cradle stop surface 40 and contact surface 52 of reset foot 50 occurs. With this engagement, further rotation of cradle assembly 18 in the reset direction (counterclockwise as shown) forces cross bar 46 to pivot back towards operating mechanism 10 (clockwise as shown) and causes latching tabs 32 to engage latching shoulders 30 of cradle assembly 18. It should be noted that circuit breaker operating mechanisms of the prior art would require a return spring to perform this relatching action. Primary latch 34 and secondary latch 54, being properly dimensioned, are then latched as notched areas 48 on primary latch 34 and notched areas 68 on secondary latch 54 engage each other. A secondary latch return spring 100 extends from a pin 102, which extends between sideplates 12, to an aperture 104 in base member 64 of secondary latch 54. Spring 100 biases secondary latch 54 in the clockwise direction, as shown. When notched areas 48, 68 are engaged, primary latch 34 is locked into the latched position by secondary latch 54, which is shown in FIG. 3. While in the prior art a torsion spring (not shown) would be used to bias primary latch 34 in a locked position, thereby effectuating the engagement of notched areas 48, 68 with tabs 32 and shoulder 30, the combination of reset foot 50 on elongated leg member 44 of primary latch 34 and notched areas 48, 68 on primary latch 34 and secondary latch 54 allows latching mechanism 14 to latch and reset operating mechanism 10 while reducing the trip time of operating mechanism 10 attributable to the force required to overcome the spring rate.

While this invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A circuit breaker assembly comprising:

a housing;

movable contact arm pivotally mounted within said housing; and an operating mechanism for moving, said movable contact arm, said operating mechanism including, a cradle plate operably connected to said movable contact arm, and a latching mechanism releasably engaging said cradle plate, said latching mechanism further comprising:

a primary latch releasably engaging said cradle plate, said primary latch including, an elongated leg member pivotally mounted within said housing, and a foot depending from a first end of said elongated leg member; and a secondary latch, releasably engaging a second end of said elongated leg member, wherein said cradle engages said foot for engaging said secondary latch with said second end of said elongated leg member.

2. The latching mechanism of claim 1 wherein said primary latch comprises two elongated leg members in a parallel relationship connected by a cross member to define an H-shape.

3. The latching mechanism of claim 2 wherein said secondary latch comprises two elongated leg members in a parallel relationship connected by a base member to define a U-shape.

4. The circuit breaker assembly of claim 1 wherein said reset foot is engageable with a cradle stop surface on an arm in a cradle assembly to prevent pivotal rotation of said cradle assembly in a first direction.

5. The circuit breaker assembly of claim 4 wherein said tab is engageable with a latching shoulder on said cradle assembly to prevent pivotal rotation of said cradle assembly in a second direction.

6. The circuit breaker assembly of claim 5 wherein said secondary latch restingly engages said notched portion of said primary latch to prevent pivotal motion of said primary latch.

7. A latching mechanism for a circuit breaker operating mechanism configured and positioned to receive a pivotally mounted cradle assembly, said latching mechanism comprising:

a primary latch including, an elongated leg member, and a foot depending from said elongated leg member, and a secondary latch including, an elongated leg member pivotally mountable to said circuit breaker operating mechanism, said elongated leg member of said secondary latch engageable with said elongated leg member of said primary latch, wherein said foot engages said cradle assembly for engaging said elongated leg member of said primary latch with said elongated leg member of said secondary latch.

8. The latching mechanism of claim 7 wherein said reset foot is engageable with said cradle assembly in a first direction.

9. The latching mechanism of claim 8 wherein said primary latch further comprises a tab engageable with a latching shoulder on said cradle assembly to prevent rotation of said cradle assembly in a second direction.

10. The latching mechanism of claim 7 wherein said primary latch comprises two elongated leg members in a parallel relationship connected by a cross member to define an H-shape.

11. The latching mechanism of claim 7 wherein said secondary latch comprises two elongated leg members in a parallel relationship connected by a base member to define a U-shape.

* * * * *